US005934027A

United States Patent [19]

Khalili

[11] Patent Number: 5,934,027

[45] Date of Patent: Aug. 10, 1999

[54] EARTHQUAKE RESISTANT BUILDING STRUCTURE EMPLOYING SANDBAGS

[76] Inventor: Ebrahim Nader Khalili, 10376 Shangri La Ave., Hesperia, Calif.

[21] Appl. No.: 09/026,994

[22] Filed: Feb. 19, 1998

[51] Int. Cl.[6] ..... E02B 1/98; E04H 9/02

[52] U.S. Cl. ..... 52/167.1; 52/80.1; 52/86; 52/89; 52/712; 405/84

[58] Field of Search ..... 52/89, 86, 80.1, 52/167.1, 582.1, 604, DIG. 10, 712; 405/273, 284, 21

[56] References Cited

U.S. PATENT DOCUMENTS

| | | | |
|---|---|---|---|
| 3,922,832 | 12/1975 | Dicker | 52/742 |
| 4,650,368 | 3/1987 | Bayer | 405/111 |
| 4,729,691 | 3/1988 | Sample | 405/21 |
| 5,584,599 | 12/1996 | Knittel | 405/15 |

*Primary Examiner*—Carl D. Friedman
*Assistant Examiner*—Nkeisha J. Maddox
*Attorney, Agent, or Firm*—Thomas R. Vigil

[57] ABSTRACT

The method of combining barbed wire and conventional bags to create structures includes the steps of: providing a plurality of bags; filling the bags with a predetermined mixture of organic, manufactured, recycled, particulate, fill material; stacking and arranging the bags in a predetermined array; and, placing at least one strand of barbed wire or similar wire between at least a major portion of the stacked layers of bags as they are being stacked to create frictional resistance to sliding between layers and tensile strength in a wall or other structure formed by the stacked layers of bags thereby to provide earthquake resistant structures. The structures include a building structure retaining wall, and an erosion resistant embankment for a body of water made by the method. The bags can be of different length, the fill material can include a cementious material thereby to create a permanent structure and one to three spaced apart strands of barbed wire can be used between layers of bags.

17 Claims, 3 Drawing Sheets

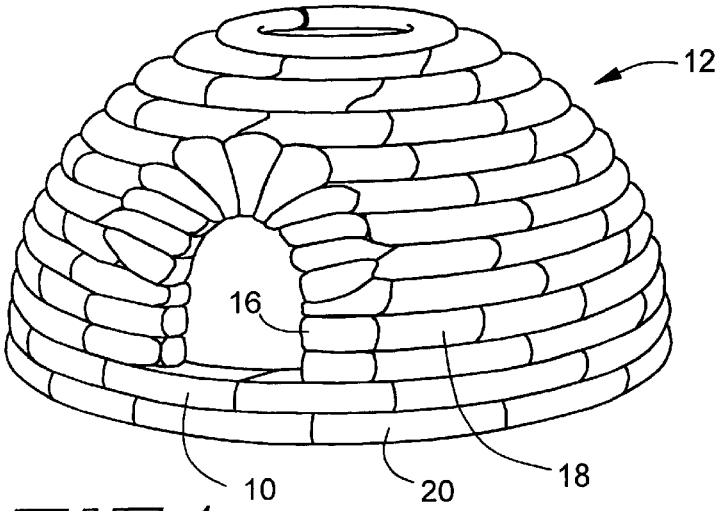
FIG. 1
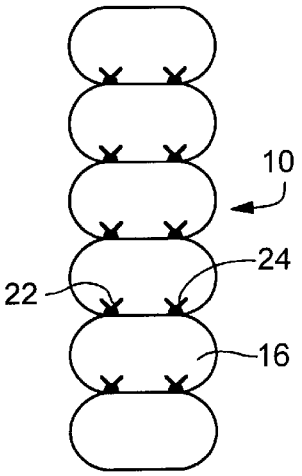
FIG. 3
FIG. 2
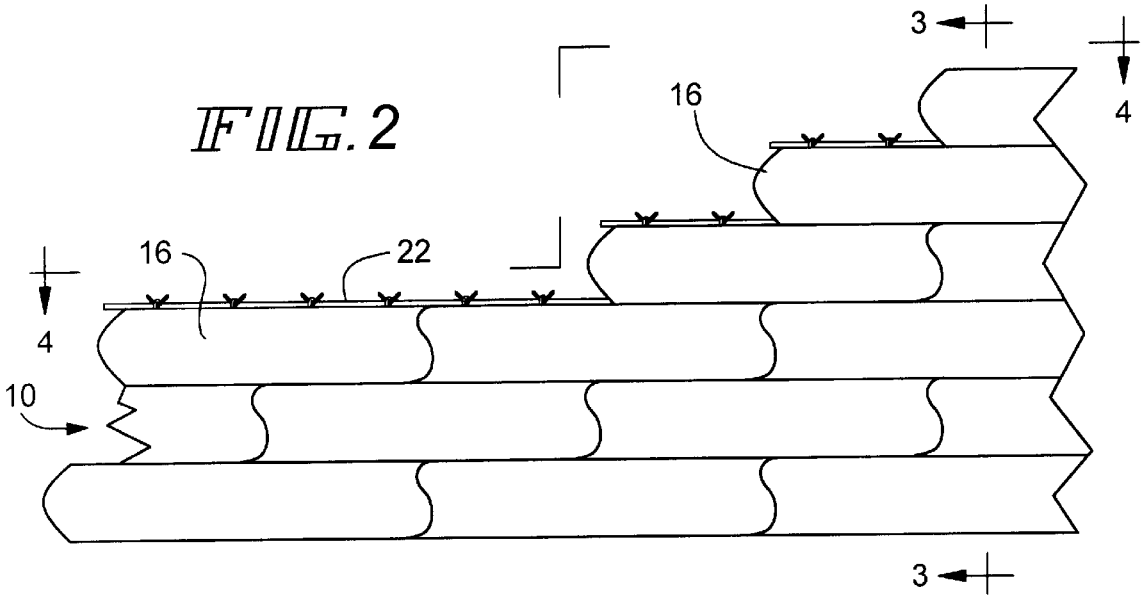
FIG. 4
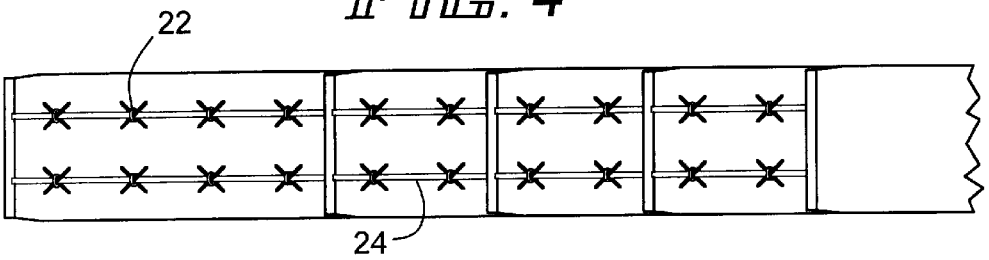

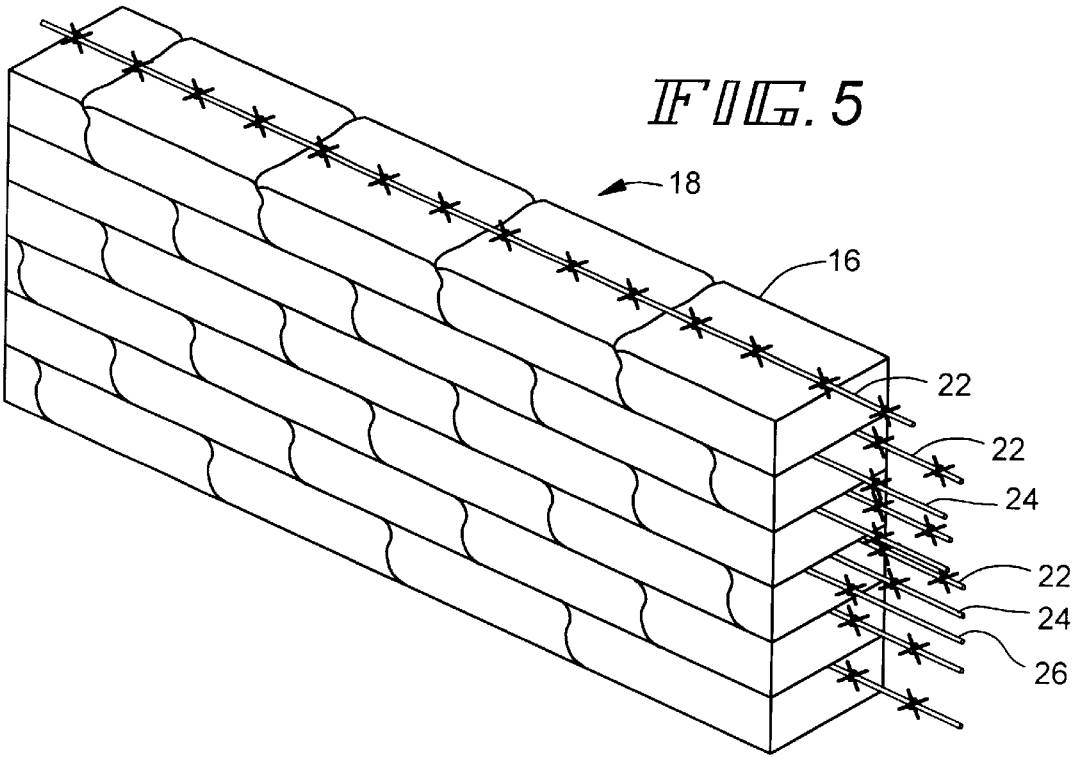
FIG. 5
FIG. 6
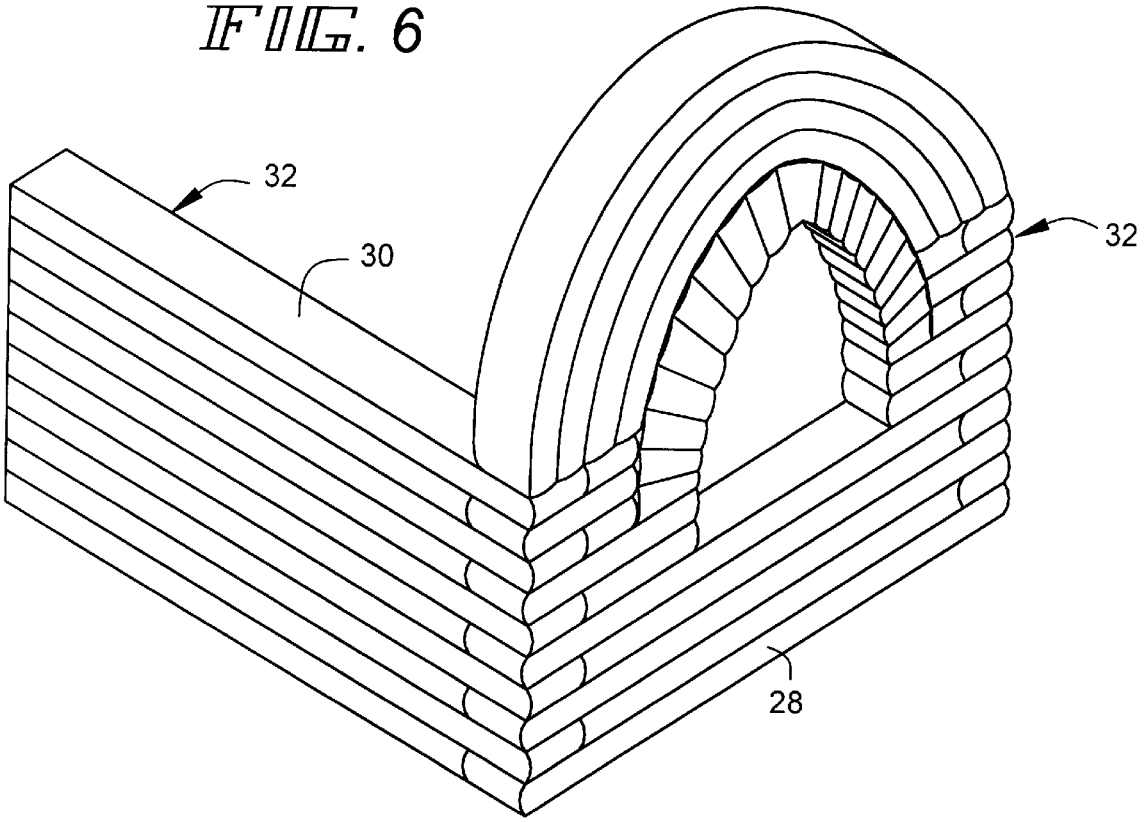

EARTHQUAKE RESISTANT BUILDING STRUCTURE EMPLOYING SANDBAGS

BACKGROUND OF THE INVENTION

1. Field of the Invention.

The present invention relates to building constructions including walls, domes, curved roof structure retaining wall system and water embankments utilizing sandbags interconnected with barbed wire to create a strong, long lasting and earthquake resistant structure.

2. Description of the Prior Art.

Sandbags have been used for centuries as elements in building temporary dikes, protection walls in combat zones, as well as numerous lesser important applications. Normally after the structure has served its temporary purpose, the sandbags have been removed, emptied and disposed of. According to the present invention a construction system is created wherein the sandbag is an integral part of a permanent system of construction.

The most serious drawback in the past concerning using sandbags as a structural element is the fact that a stack of bags has no tensile capabilities. This kept any structure very low in height. Curved, arched or domed structures were impossible without some tensile resistance being available.

According to the present invention, the use of barbed wire or a similar element between sandbag layers allows one to develop the tensile and shear capabilities which has not been considered in the past.

The second problem with using sandbags as part of a permanent structure is the potential deterioration of the bag and the subsequent effect on the structure.

According to the present invention stabilized or unstabilized, adobe or other overlay materials are used to shield the sandbags from the elements and the effect of the elements on the deterioration of a sandbag structure.

The third problem with the use of sandbags as part of a permanent structure has been due to the use of loose fill material, usually sand, which can be loaded easily and gotten rid of when the temporary structure is disposed of.

As will be described in greater detail hereinafter, different mixes of fluent, particulate material are used to fill the sandbag, which include, on occasion, organic, manufactured, recycled or cementious materials that shape the fill material into a permanent block.

The shape of any structure is of primary importance in order to take advantage of the building material being used. Modern building materials such as structural steel, plywood, mill lumber, and a multitude of other items are normally made available with rectangular shapes. This has made the construction of curved wall or roof structures difficult if not impossible. In addition, it becomes very expensive to construct curved surfaces with flat materials. All mating surfaces are normally flat and make the construction of curved surfaces nearly impossible. The sandbag, because of its flexibility allows us to construct curved surfaces easily and economically.

In the past, the construction of domed or arched surfaces, has required the extensive use of falsework to support the roofs until they are completed and self supporting. The stepping and sloping of sandbags allows us to build these structure without the use of forms.

The design of sandbag structures can be very expensive because each building becomes a very unique structure. Modern computers now allow for the design on an individual basis.

Heretofore, it has been proposed to provide metal wire trellises filled with stone for a dam in the Kato U.S. Pat. No. 2,145,396.

Also, the Brown U.S. Pat. No. 5,030,031 and the Mohss U.S. Pat. No. 5,593,623 teach the provision of elongate bags, such as sand bags, for receiving dirt or other particulate matter.

Then, the Bradley U.S. Pat. No. 5,505,557 discloses an elongate geotextile container of generally circular crosssection for receiving fill and for being positioned along a river bank for preventing erosion of the river bank.

Previously proposed structures for holding sand bags together are disclosed in the Dicker U.S. Pat. No. 3,922,832 which teaches vertical reinforcing rods extending between layers of porous sacks containing a dry premixed fill of aggregate, sand and cement, the Bayer U.S. Pat. No. 4,650,368 which teaches hook and loop pile fasteners (Velcro®) attached to adjacent sand bags in stacked layers to aid in stacking and retaining sand bags in a vertically stacked relation, and the Knittel U.S. Pat. No. 5,584,599 which teaches a pair of spaced straps secured to a sand bag and having end loops extending outwardly from the bag through which loops of straps of a superimposed sand bag can be inserted.

SUMMARY OF THE INVENTION

The use of domes and bearing walls in building construction, can contribute a number of beneficial results for the builder and the user of such structures.

1. Unlike beam and column structures, domes transfer their stresses along the surface of the structure not from element to element. When a single element in beam and column construction is overloaded to failure, the failure of that element will create a cascading effect on adjacent elements, causing a general failure of all elements in the vicinity of the failed part. In many cases, such a failure will cause the entire structure to collapse. A dome will not allow such an event to occur. There are protections provided by a dome which prevent such a failure. It is not possible to impose excessive loads on the surface of dome without causing a puncture failure. This results in the excessive load being shed by the structure with only localized damage. Other loads on the structure are still held by, and the stresses in the vicinity of a failure are transmitted around, the failed area without any problem.

2. Dead load and live load stresses are transferred to the supporting ground in a uniform pattern along the perimeter of a dome or bearing wall. In a beam and column structure, all of the loads are transferred to the ground via a footing under each column. This situation creates two basic structural problems.

The first is that settlement beneath all of the columns in a structure will never be uniform. This is known as differential settlement and the problem in itself can create very large stresses within the structure causing localized cracking and other failures.

The second problem with footing and foundations is that provisions must be made to prevent damage from frost heaving. In a column structure, frost heaving can induce severe localized stresses. For this reason, most foundations are extended below the frost line to minimize such problems. In a domes structure neither of these problems will normally occur. The base of the dome or bearing wall distributes the load of the structure over a much larger area and local soft spots in the supporting soil will not create a local problem because the dome or wall will span local depressions with no problem. The effect of frost on a dome structure will also not be a problem since the dome is free to float on the ground.

3. One of the most significant advantages of a domed or bearing wall structure is in earthquake zones. Conventional structures are very difficult to design to withstand earthquake stresses. Their basic shape creates a severe problem with the building weight either being uniformly spread from the top to the bottom, or even worse there are many cases where the weights within the structure can be larger in the upper floors of the building. In addition the deeply planted footings and foundations rip apart the very base structure of a building during an earthquake, causing failures, rather than preventing them.

Modern earthquake design incorporates foundation isolation, with shifting capabilities being permitted. This is effective but very expensive. A domed or bearing wall structure, built on a floating foundation provides the ideal earthquake resistant structure. The ring foundation can slide across the moving ground with no damage to the structure itself. In addition, the weight of the structure diminishes dramatically as one goes higher on the building. This eliminates local failure higher up on the structure.

According to the present invention, arches, domes, and bearing walls are constructed and assembled in an economical and structurally efficient way. The building construction of the present invention permits the construction of curved wall structures which are self supporting.

4. The construction of infrastructures, structures and shielding elements, such as, for thermal, radiation, UV and impact shielding on the moon, other planets, space stations, etc. can involve costly transportation of building materials into outer space. The utilization of in-situ materials or materials imported from a closer site than earth,is crucial to space exploration. The most appropriate forms for such structures and shieldings are single and double curvature structures constructed according to the teachings of the present invention from locally obtained and minimally processed materials.

It is an important aspect of the present invention to provide for the transfer of shear stresses from one sandbag to another by using a barbed wire (or other similar material) as an interface between the bags. This creates the capability of designing higher walls and curved surfaces with sandbags.

A further aspect of the present invention is the creation of tensile resistance in a wall or structural element by using barbed wire (or other similar material) as a tension resisting element.

Still another aspect of the present invention is to enable for individuals to construct their own homes or storage areas without the use of heavy erection equipment. All of the materials are native to the country of use. All of the skills required are simple and can be acquired by anyone who wishes to learn them.

It is another aspect of the invention to use standard sandbags or very long sandbags laid out as a very long tube for bank stabilization applications.

It is another aspect of the invention to use standard sandbags or very long sandbags laid out in a spiral form to create domes or arched structures.

It is another aspect of the invention to use standard sandbags or very long sandbags folded back on themselves to create bearing walls or retaining wall structures.

It is another aspect of the present invention to use different fill materials for filling sandbags ranging from loose sand and/or aggregate to a concrete mix with everything in between.

It is another aspect of the invention to use standard or very long sandbags in straight or single and double curvature structures on the moon, planets, asteroids and planetary stations for structural, infrastructural and shielding functions.

According to the present invention there is provided a method of combining barbed wire and conventional bags to create structures including the steps of: providing a plurality of bags; filling the bags with a predetermined mixture of fluent, particulate, fill material; stacking and arranging the bags in a predetermined array; and, placing at least one strand of barbed wire or similar wire between at least a major portion of the stacked layers of bags as they are being stacked to create frictional resistance to sliding between layers and tensile strength in a wall or other structure formed by the stacked layers of bags thereby to provide earthquake resistant structures.

Also, according to the present invention there is provided a building structure made by the method.

Further, according to the present invention there is provided a retaining wall system, and an erosion resistant embankment for a body of water made by the method.

The bags can be of different length, the fill material can include organic, manufactured, recycled and cementious material thereby to create a permanent structure and one to three spaced apart strands of barbed wire can be used between layers of bags.

BRIEF DESCRIPTION OF THE DRAWINGS

FIG. 1 is a perspective view of a dome shaped building constructed according to the teachings of the present invention.

FIG. 2 is a fragmentary elevational view of part of a building wall constructed with sandbags according to the teachings of the present invention.

FIG. 3 is an elevational sectional view through six layers of sandbags and is taken along line 3—3 of FIG. 2.

FIG. 4 is a top plan view of the section of building wall shown in FIG. 2, is taken along line 4—4 of FIG. 2 and shows two spaced apart strands of barbed wire between layers of sandbags.

FIG. 5 is a perspective view of a section of building wall and shows different numbers, one two or three, of strands of barbed wire between layers of sandbags.

FIG. 6 is a perspective view of part of a building constructed according to the teachings of the present with an arched structure and a curved roof.

DESCRIPTION OF THE PREFERRED EMBODIMENT(S)

Figure 7:
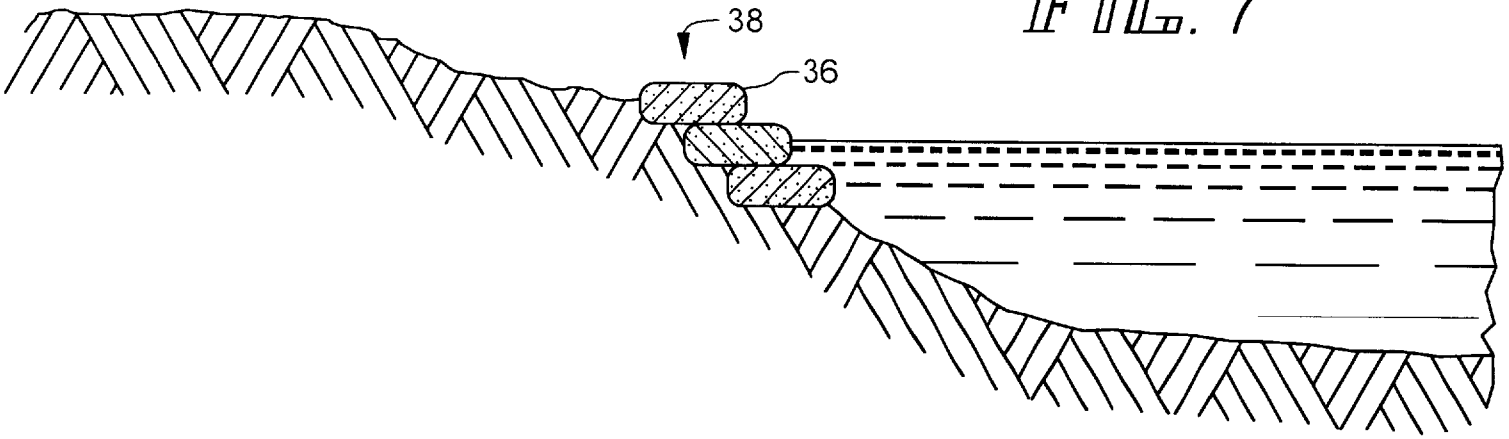
FIG. 7 is a sectional elevational view of three elongate sandbags stacked in an offset stepped arrangement along an embankment to serve as a retaining wall and/or to protect the bank from erosion.

Referring now to FIG. 1 of the drawings in greater detail, the method of constructing and the structures so constructed according to the teachings of the present invention, utilizes one or more strands of barbed wire as a structural element in the construction of a wall 10 of a building 12 to create frictional resistance to sliding and tensile strength in the wall 10 to prevent local collapse or tensile failures of a curved surface in the building.

The particular building 12 illustrated in FIG. 1 is a dome shaped building 12 which is constructed from a plurality of sandbags 16, 18, 20, etc., of varying length with one to three strands, e.g. strands 22 and 24, as shown in FIG. 4, situated between each layer of superimposed sandbags 16 etc. It is to be understood that the building 12 also can be constructed from fewer but longer sandbags and even from a continuous sandbag which forms a continuous building element with structural integrity for creating a domed structure. The sandbags are filled with organic, manufactured and recycled materials, or with fluent particulate matter including sand, earth, small stones or pebbles and if desired a cementious material.

The barbed wire reinforcement provides both sliding resistance and tensile strength.

Typically and preferably and as shown in FIGS. 3 and 4, two strands 22 and 24 are arranged in a parallel spaced apart manner between the layers of sandbags 16, etc.

As shown in FIG. 5 of the drawings, one to three strands 22, 24 and 26 of barbed wire can be utilized.

Long sandbags 28 and 30 can be employed in constructing a long wall 32 or an arched end wall 34 as shown in FIG. 6.

Figure 8:
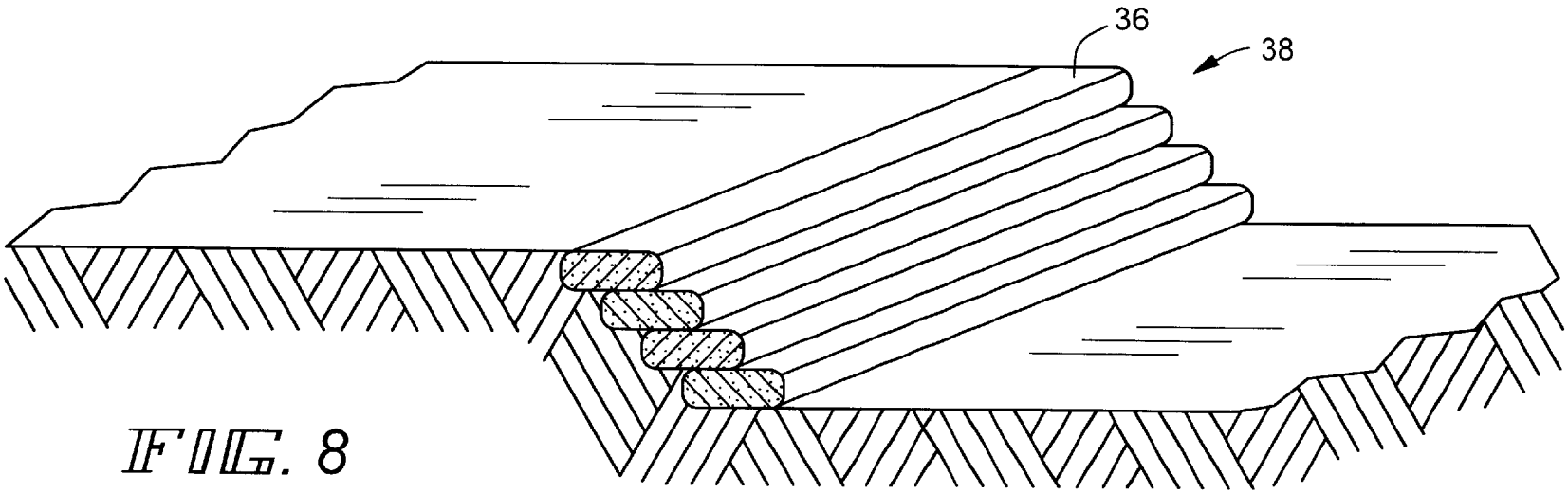
FIG. 8 is a partially perspective view of four elongate sandbags stacked in an offset stepped arrangement along an embankment to serve as a retaining wall and/or to protect the bank from erosion.

The barbed wire reinforcement system of the present invention can also be employed in a bank erosion resistant or retaining wall structure as shown in FIGS. 7 and 8. Here, the system utilizes a continuous bag 36 which forms a continuous building element with structural integrity for creating an erosion resistance structure 38 for the stabilization of any slopes and the bank of a stream, lake, river or any other application of this type.

Typically, continuous sandbags 36 in a straight or undulated line are stacked one upon another in a staggered or offset manner as shown in FIGS. 7 and 8.

The use of unlimited length sandbags creates a structure which is resistant to local failure which is common in existing designs. The use of geotextile materials in combination with sandbags constructed according to the teachings of the present invention, allows for extremely large or deep retainments or stabilization structures. The barbed wire reinforcement provides both sliding resistance and tensile strength and allows for the tie in of buttresses. The buildings constructed by the method of the invention are highly earthquake resistant and can serve to provide shelter in all types of climates.

Further, the use of permanent sandbags allows for the interfacing of an arch with a wall and the stabilizing of the arch.

From the foregoing description, it will be understood that the method of the present invention and the structures formed using the method have a number of advantages, some of which have been described above and others of which are inherent in the invention. Also, it will be understood that modifications can be made to the method and the structures constructed using the method of the present invention without departing from the teachings of the invention. Accordingly, the scope of the invention is only to be limited as necessitated by the following claims.

We claim:

1. A method of combining barbed wire and conventional bags to create structures including the steps of:

providing a plurality of bags;

filling the bags with a predetermined mixture of fluent, particulate, fill (organic, manufactured or recycled) material;

stacking and arranging the bags in a predetermined array; and, placing at least one strand of barbed wire or similar tension elements between at least a major portion of the stacked layers of bags as they are being stacked to create frictional resistance to sliding between layers and tensile strength in a wall or other structure formed by the stacked layers of bags thereby to provide earthquake resistant structures.

2. The method of claim 1 wherein said structures created with the method are permanent structures.

3. The method of claim 1 wherein said fill material includes, at least in part, organic, manufactured, recycled or cementious materials.

4. The method of claim 1 wherein at least two spaced apart strands of barbed wire are placed between a major portion of the layers of bags.

5. The method of claim 4 wherein the strands are parallel space apart.

6. The method of clam 1 wherein said bags are of various lengths, from several feet to thousands of feet in length.

7. The method of claim 1 wherein the fill material is selected from: sand, dirt, gravel, aggregate, stones, rocks, straw, pulp, recycled and cementious materials.

8. A building constructed by the method of claim 1.

9. An erosion resistant embankment for a body of water or retaining wall constructed by the method of claim 1.

10. A building structure including building walls comprising a plurality of stacked layers of bags each being filled with a fluent, particulate fill material and at least one strand of barbed wire or similar wire situated between at least a major portion of said stacked layers of bags to create frictional resistance to sliding between layers and tensile strength in the wall formed by the stacked layers of bags thereby to provide an earthquake resistant building structure.

11. The building structure of claim 10 wherein said fill material includes organic, recycled or cementious material thereby to provide a permanent building structure.

12. The building structure of claim 10 wherein said bags are of varying length.

13. The building structure of claim 10 wherein at least two spaced apart strands of barbed wire are situated between a major portion of the layers of bags.

14. An erosion resistant embankment for a body of water or retaining wall comprising at least two stacked layers of bags each being filled with a fluent, particulate fill material and at least one strand of barbed wire or similar wire situated between at least a major portion of said stacked layers of bags to create frictional resistance to sliding between layers and tensile strength in the embankment wall formed by the stacked layers of bags thereby to provide an earthquake resistant embankment.

15. The embankment of claim 14 wherein said fill material includes a cementious material thereby to provide a permanent embankment.

16. The embankment of claim 14 wherein said bags are of varying length.

17. The embankment of claim 14 wherein at least two spaced apart strands of barbed wire are situated between a major portion of the at least two layers of bags.

* * * * *